United States Patent [19]

Bruni et al.

[11] 4,132,874

[45] Jan. 2, 1979

[54] ELECTRICAL SWITCH

[75] Inventors: Aldo Bruni; Luigi Campari, both of Turin, Italy

[73] Assignee: AMP Incorporated, Harrisburg, Pa.

[21] Appl. No.: 758,288

[22] Filed: Jan. 10, 1977

[30] Foreign Application Priority Data

Jan. 8, 1976 [GB] United Kingdom ..... 00580/76

[51] Int. Cl.[2] ..... H01H 15/02; H01H 1/42

[52] U.S. Cl. ..... 200/16 F; 200/254; 200/303

[58] Field of Search ..... 200/15, 16 F, 16 C, 200/16 D, 238, 254, 255, 256, 275, 291, 303, 11 D, 16 R, 16 B

[56] References Cited

U.S. PATENT DOCUMENTS

| | | | |
|---|---|---|---|
| 2,565,643 | 8/1951 | Baddour | 200/15 X |
| 3,263,036 | 7/1966 | Flanagan | 200/16 F X |
| 3,737,593 | 6/1973 | Williamson | 200/11 D |
| 3,883,705 | 5/1975 | Sebastian et al. | 200/303 X |
| 3,947,391 | 3/1976 | Lutzenberger | 200/16 D |
| 3,974,346 | 8/1976 | Keprda | 200/16 D |

FOREIGN PATENT DOCUMENTS

| | | | |
|---|---|---|---|
| 2700200 | 7/1977 | Fed. Rep. of Germany | 200/16 F |

*Primary Examiner*—James R. Scott
*Attorney, Agent, or Firm*—Allan B. Osborne

[57] ABSTRACT

An electrical switch comprising two contacts each stamped and formed from a single piece of sheet metal stock and having a post and a receptacle portion comprising two opposed spring arms extending in flag fashion from the post, the two contacts being located in an insulating housing in spaced apart relation with mouths of their receptacle portions mutually opposed and the posts projecting out of the housing from the housing base, an elongate metal slider located in the housing in alignment with the mouths and slidable between first and second switching positions in which it is gripped by the arms of only one receptacle portion and of both receptacle portions respectively. The spring arms may be bowed inwardly to different radii at their free ends.

6 Claims, 3 Drawing Figures

ELECTRICAL SWITCH

BACKGROUND OF THE INVENTION

Field of the Invention

The invention relates to an electrical switch for mounting on a printed circuit board.

SUMMARY OF THE INVENTION

The switch, according to the invention, comprises two contacts each stamped and formed for a single piece of sheet metal stock and having a post and a receptacle portion comprising two opposed spring arms extending in flag fashion from the post, the two contacts being located in an insulating housing in spaced apart relation with mouths of their receptacle portions mutually opposed and the posts projecting out of the housing from the housing base, an elongate metal slider located in the housing in alignment with the mouths and slidable between first and second switching positions in which it is gripped by the arms of only one receptacle portion and of both receptacle portions, respectively.

The spring arms of each receptacle portion may be joined at their root ends adjacent the post, their free ends defining the mouth.

The spring arms may be bowed inwardly at their free ends, the bowed end of one arm being of smaller radius than the bowed end of the other opposed, arm.

The slider may be provided with means for engaging the bowed ends of the arms to locate it in either switching position. Preferably the locating means comprises depressions spaced longitudinally of the slider.

The housing may be provided with a channel or rails extending across the base between each receptacle portion defining a guide path for the slider which may be chamfered along a lower longitudinal edge for reception in the channel or between the rails.

Each receptacle may be provided with a pair of ears at the root end of each arm which ears are received as an interference fit in a cavity formed in the housing base to assist in locating the contacts in the housing.

The spring arms may be of decreasing width towards their bowed ends which may be embossed to provide protuberances for engaging in the depressions on the slider.

The housing may be bipartite having a base portion and a lid portion, the lid portion being engageable on the base portion as a snap fit and having an aperture for providing access to the slider.

The slider may be provided with an operating arm extending through the lid aperture a longitudinal edge of which aperture may be formed with a pimple extending into the path of movement of the operating arm. The arm rides over the pimple on movement between switch positions.

An embodiment of a multiple electrical switch according to the invention will now be described with reference to the accompanying drawings.

DESCRIPTION OF THE INVENTION

Figure 1:
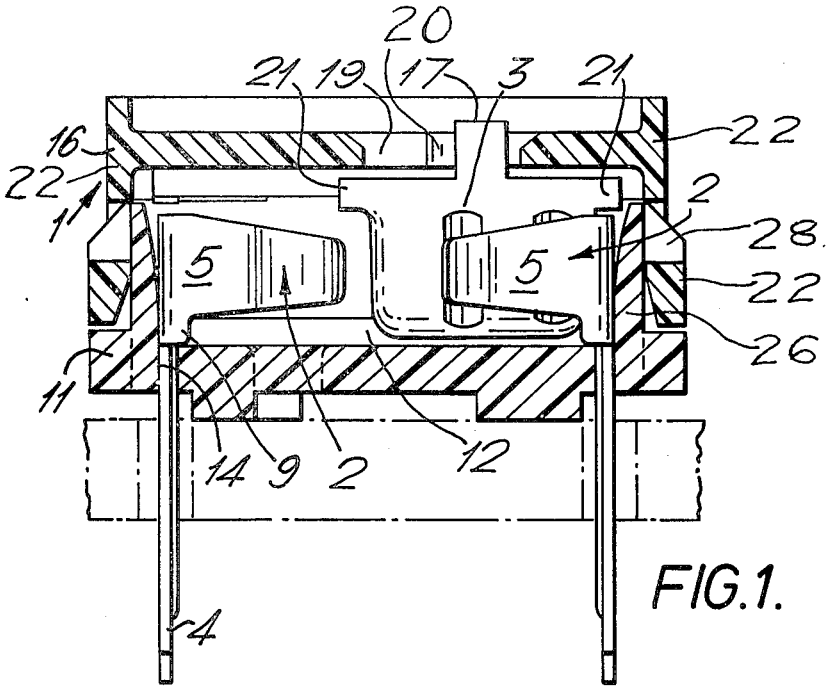
FIG. 1 is an elevational view of the switch with the switch housing in cross-section.
Figure 2:
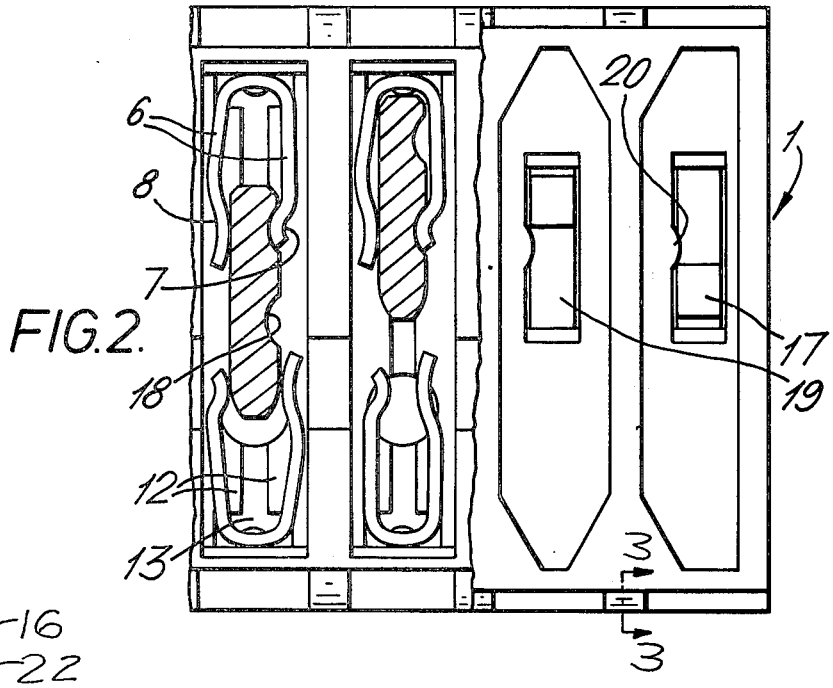
FIG. 2 is a plan view of the switch, partly in cross-section and, FIG. 3 is a cross-sectional view taken along lines 3—3 in FIG. 2.

The multiple switch comprises a housing 1 divided into a series of compartments each containing two spaced contacts 2 and a slider 3.

Each contact is stamped and formed from a single piece of sheet metal stock and comprises a post 4 and a receptacle portion 5 having two opposed spring arms 6 integrally connected at root ends to extend in flag fashion from the post. The spring arms are bowed inwardly at their free ends, one bowed end 7 being of smaller radius than the other 8. Ears 9 are formed at the root ends of the arms.

The housing 1 comprises a base 11 and a lid 16 latched on to the base. A pair of parallel guide rails 12 extend across the base and a cavity 13 is defined at opposite ends of the rails for receiving the ears 9. Post-receiving apertures 14 extend through the base in each cavity. The contacts are located in the housing in spaced apart relation with the receptacle mouths aligned both with each other and with the guide rails by their posts which are inserted through the apertures 14 and their ears which are received in the cavities as an interference fit.

The slider 3 is stamped from a single piece of sheet metal stock and comprises an elongate body having a lower longitudinal edge chamfered for reception between the guide rails. An operating arm 17 extends upwardly from an upper longitudinal edge and a pair of spaced and parallel locating channels 18 are stamped in one side.

An upper wall of the housing lid is formed with a slot 19 through which the arm 17 extends. A pimple 20 is formed on a longitudinal edge of the slot and extends into the path of movement of the operating arm. The upper edge of the slider has longitudinal extensions 21 so that the slot is covered in both switch positions to prevent entry of dust. The extensions also assist in stabilising and guiding the slider during switching movement.

Figure 3:
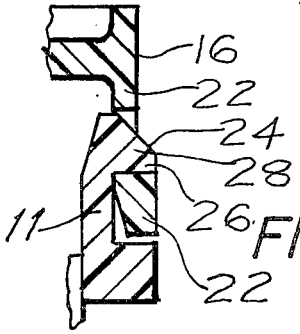

FIG. 3 shows in detail one method of securing lid 16 to base 11. The opposing lateral walls 22 of the lid have an opening 24 and the adjacent walls 26 of base 11 have a laterally projecting nose 28. As the lid is placed onto the base the lower portion of the walls are cammed outwardly over nose 28. As they pass, they spring back in under the nose which now protrudes through opening 24. The catching of the nose in the opening secures the lid to the base.

In operation of the switch, the slider is movable between a first switching position in which it is gripped by only one pair of opposed spring arms and a second switching position in which it is gripped by both pairs. In each position, registration of the bowed end 7 with the respective depressions resists accidental movement of the slider as does the pimple 20.

The switch is relatively inexpensive to manufacture requiring only four different parts which can either be moulded in one piece or stamped and formed. The parts are also suitable for automatic assembly the ears being received in an interference fit in the cavities 13 to locate the contacts on the base and the cover snap-fitted to the base after location of the slider between the contacts. As no forming operations are required on the contacts subsequent to location in the housing relatively small manufacturing tolerances may be adhered to reliably.

The switch can be of small size, having a relatively low height which is important for application on printed circuit boards where board separation should often be minimal. The differing radius of the free ends of the arms enables both a positive detent action and a good electrical contact to be maintained in the slider.

What is claimed is:

1. An electrical switch comprising, two contacts each stamped and formed from a single piece of sheet metal stock and having a post and a receptacle portion comprising two opposed spring arms joined together at their root ends adjacent the post and extending in flag fashion therefrom with the free ends being bowed inwardly, one of said bowed ends being of smaller radius than the opposed bowed end, the two contacts being located in an insulating housing in spaced apart relation with mouths of their receptacle portions mutually opposed and the posts depending from the housing, an elongated conductive slider contact located in the housing in alignment with the mouths and having complementary locating means for engaging the bowed ends of the arms, said slider contact slidable between first and second switching positions in which it is gripped by the arms of only one receptacle portion and of both receptacle portions respectively.

2. An electrical switch according to claim 1 in which the complementary locating means includes depressions spaced longitudinally on the slider contact, said depressions removably receiving the bowed end of one of said arms.

3. An electrical switch according to claim 2, in which the housing is provided with a channel or rails extending across the base between each receptacle portion defining a guide path for the slider contact which is chamfered along a lower longitudinal edge for reception in the channel or between the rails.

4. An electrical switch according to claim 3, in which each receptacle portion is provided with a pair of ears at the root end of each arm which ears are received as an interference fit in a cavity formed in the housing base to assist in locating the contacts in the housing.

5. An electrical switch according to claim 4 in which the housing is bipartite having a base portion with a laterally projecting nose on at least one upright wall and a lid portion having an opening on at least one depending wall, the lid portion being engageable on the base portion and secured thereto by said nose protruding through the opening, the lid portion further having on an upper surface an aperture for providing access to the slider contact.

6. An electrical switch according to claim 5 in which the slider contact is provided with an operating arm extending through the lid aperture a longitudinal edge of which aperture is formed with a pimple extending into the path of movement of the operating arm and over which the arm rides on movement between switch positions.

* * * * *